US008522408B2

(12) United States Patent
Lill

(10) Patent No.: US 8,522,408 B2
(45) Date of Patent: Sep. 3, 2013

(54) CATCH BASIN CLAMP SYSTEM

(75) Inventor: Clifford F. Lill, Hawthorne, NJ (US)

(73) Assignee: Campbell-ERS L.L.C., Harrison, NJ (US)

( * ) Notice: Subject to any disclaimer, the term of this patent is extended or adjusted under 35 U.S.C. 154(b) by 664 days.

(21) Appl. No.: 12/498,621

(22) Filed: Jul. 7, 2009

(65) Prior Publication Data

US 2011/0005045 A1 Jan. 13, 2011

(51) Int. Cl.
*F16B 2/06* (2006.01)
*E01F 5/00* (2006.01)

(52) U.S. Cl.
USPC ..... 24/514; 411/174; 404/5

(58) Field of Classification Search
USPC ..... 24/289, 290, 292, 293, 294, 295, 24/457, 569, 514; 210/162, 163; 404/2, 404/4, 5; 248/229.2, 229.26, 226.11, 228.1, 248/231.21; 411/174, 173, 172
See application file for complete search history.

(56) References Cited

U.S. PATENT DOCUMENTS

| | | | | |
|---|---|---|---|---|
| 505,130 | A | 9/1893 | Ryan | |
| 1,654,246 | A | 12/1927 | Egan | |
| 1,941,589 | A | 1/1934 | Wellons | |
| 2,323,886 | A | 7/1943 | Wirz, Jr. | |
| 3,034,753 | A * | 5/1962 | Johnston et al. | 248/59 |
| 3,342,237 | A * | 9/1967 | Meehan | 411/166 |
| 3,477,751 | A * | 11/1969 | Bos | 52/698 |
| 3,581,354 | A * | 6/1971 | Usiskin | 24/569 |
| 4,461,597 | A | 7/1984 | Laurin | |
| 4,594,157 | A | 6/1986 | McGowan | |
| 5,071,177 | A | 12/1991 | Spiess et al. | |
| 6,474,917 | B2 * | 11/2002 | Gauron | 411/112 |
| 7,128,495 | B1 | 10/2006 | Lill et al. | |
| 7,160,048 | B1 | 1/2007 | Fattori et al. | |
| 7,648,319 | B1 * | 1/2010 | Ochoa et al. | 411/174 |
| 2005/0039311 | A1 * | 2/2005 | Schwope | 24/335 |
| 2007/0086856 | A1 * | 4/2007 | Lill et al. | 404/4 |
| 2009/0067922 | A1 * | 3/2009 | Fattori et al. | 404/4 |
| 2009/0242720 | A1 * | 10/2009 | Charters | 248/352 |

FOREIGN PATENT DOCUMENTS

| | | |
|---|---|---|
| JP | 10140591 | 5/1998 |
| JP | 2000120096 | 4/2000 |
| JP | 2004011247 | 1/2004 |

* cited by examiner

*Primary Examiner* — Robert J Sandy
*Assistant Examiner* — Michael Lee

(57) ABSTRACT

A clamp includes a base section, from which a pair of sidewalls and prongs extend, where the prongs are designed to grip gussets within the curb inlet and maintain proper alignment with designated portions of the restrictor plate despite manufacturing variations in gussets positioning within the curb inlet. The clamp is capable of securely positioning a floatable restrictor plate within or flush with an opening of the curb inlet so as to prevent floatables from entering storm sewer systems through the curb inlet.

14 Claims, 7 Drawing Sheets

CATCH BASIN CLAMP SYSTEM

BACKGROUND OF THE INVENTION

1. Field of the Invention

The invention relates to mounting restrictor plates flush with and/or within a catch basin curb inlet.

2. Background

Private groups and government bodies, such as the United States Environmental Protection Agency (U.S.E.P.A.), have sought to control unregulated sources of storm water discharge that have the greatest likelihood of causing continued environmental degradation. Such sources include storm water runoff, which picks up and transports harmful pollutants and discharges them-untreated-to waterways via sewer systems. Sediment-laden, contaminated runoff can overwhelm local water bodies, particularly small streams, resulting in streambed scour, stream bank erosion, and destruction of near-stream vegetative cover. The further result is the loss of in-stream habitats for fish and other aquatic species, an increased difficulty in filtering drinking water, the loss of drinking water reservoir storage capacity, and negative impacts on the navigational capacity of waterways.

In attempting to control unregulated sources of storm water discharge, specific-use plates, known as floatable restrictor plates, have been connected to the front opening of a catch basin curb inlet for preventing floatables from entering storm sewer systems through the curb inlet. However, the known method for connecting the restrictor plate to the curb inlet positions the restrictor plate past the front plane of the opening of the curb inlets. This placement positions the restrictor plate outside of the protection of the curb inlet and in the path of machinery which sweeps against the front face of the curb inlet, such as snow plows. The result is damage to the restrictor plate, the snow plow, or both.

The present inventors have conceived of one solution, which is to position the restrictor plate within or flush with an opening of a catch basin curb inlet. Curb type catch basins are manufactured in varying shapes and sizes designed to create a street level inlet for water at the curb line as well as a vertical opening for water through the curb face. The various shapes and sizes came about as different state and local agencies designed and developed their own storm water management solutions since the development of roadways for cars.

One example of a known curb inlet which could be fitted with a flush or internally mounted restrictor plate is curb inlet 10, illustrated in FIG. 3. The height of the back of the illustrated curb inlet 10 is approximately one foot, though heights range from four inches to a foot, and are fixed or adjustable. The width of the illustrated curb inlet is approximately three feet, though widths range from two to four feet. The depth of the illustrated curb inlet is approximately six inches. The curb inlet 10 includes a plurality of strengthening gussets 12 (or ribs) molded integrally therein which are spaced along the length of the curb inlet 10.

Plural clamps could be utilized, each one gripping a designated portion of the restrictor plate and a respective gusset 12 for proper positioning of the restrictor plate. However, a known manufacturing issue regarding the curb inlet 10 would prevent proper gripping of all gussets 12 in a curb inlet. That is, the curb inlet 10 is formed by pattern and/or sand casting. Normal variations from such formation methods cause the position of the gussets 12 to vary horizontally (i.e., lengthwise along the curb inlet) within a predetermined tolerance. Such a position variance would create a misalignment between the gussets any portion of the restrictor plate designated to be clamped, so as to prevent proper clamping.

Accordingly, what is needed is a clamp which is capable of positioning a restrictor plate within or flush with the front opening of the curb inlet. The clamp would be able to grip the gussets of the curb inlet and maintain proper alignment with designated portions of the restrictor plate despite manufacturing induced variations in gussets positioning within the curb inlet.

SUMMARY OF THE INVENTION

A clamp includes a base section, from which a pair of sidewalls and prongs extend, where the prongs are designed to grip gussets within the curb inlet and maintain proper alignment with designated portions of the restrictor plate despite manufacturing variations in gussets positioning within the curb inlet. The clamp is capable of securely positioning a floatable restrictor plate within or flush with an opening of the curb inlet so as to prevent floatables from entering storm sewer systems through the curb inlet.

BRIEF DESCRIPTION OF THE FIGURES

It is to be understood that the following drawings depict details of only typical embodiments of the invention and are not therefore to be considered to be limiting of its scope, and in particular.

DESCRIPTION OF THE EMBODIMENTS

Overview

Figure 1:
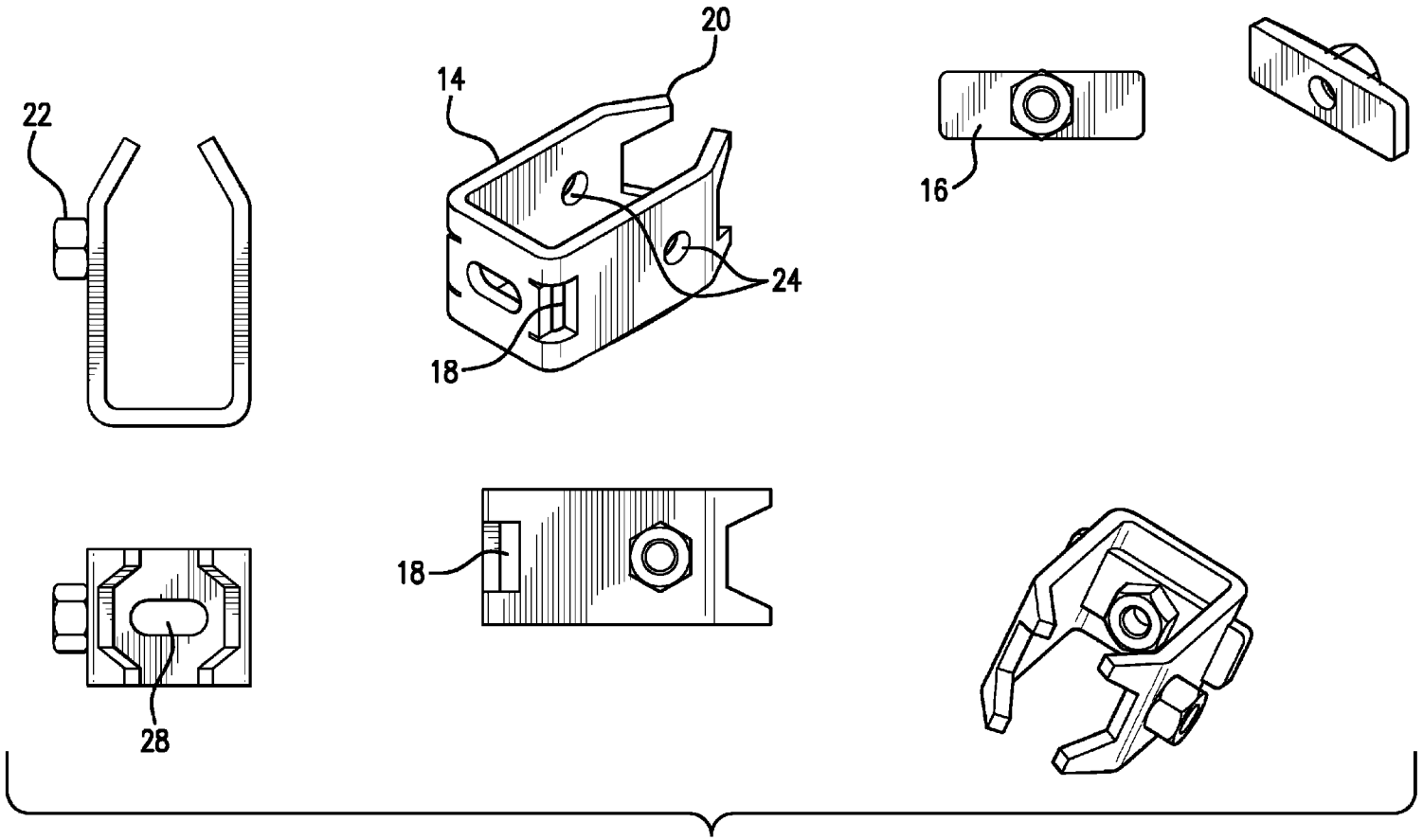
FIG. 1 illustrates a clamp and a clamp adjusting bar.

A clamp 14 (FIGS. 1, 3 and 4) includes a base section, from which a pair of sidewalls and prongs 20 extend, where the prongs 20 are designed to grip gussets 12 within the curb inlet 10 and maintain proper alignment with designated portions of the restrictor plate 30 despite manufacturing variations in gussets 12 positioning within the curb inlet 10. The clamp 14 is capable of securely positioning a floatable restrictor plate 30 (FIGS. 2, 3 and 4) within or flush with an opening of the curb inlet 10 so as to prevent floatables from entering storm sewer systems through the curb inlet 10.

The Restrictor Plate Gripped by the Clamp

The outer perimeter of the restrictor plate 30 is sized so that the restrictor plate 30 can be positioned inside, or positioned to just touch, the front face opening of the curb inlet 10. The restrictor plate 30 has an impact strengthening bend L (FIGS. 2 and 4) along its upper and/or lower edge, though the lower bend is illustrated in the figures. The strengthening bend 32 spans the length of the edge of the restrictor plate 30 and is directed substantially perpendicularly away from the restrictor plate 30, into the opening of the curb inlet 10. The strengthening bend 32 creates connected intersecting planes, adding rigidity to the plate. The added rigidity helps the restrictor plate 30 absorb impacts from roadway clutter, trash, stones, etc.

Figure 2:
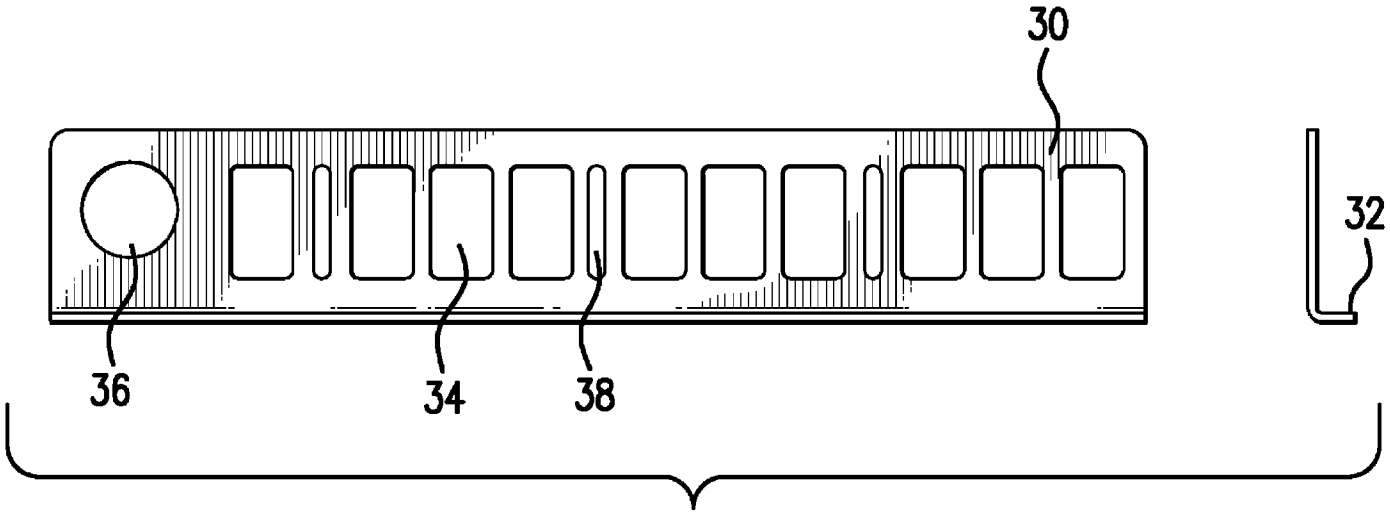
FIG. 2 illustrates a restrictor plate.

The restrictor plate 30 has a stainless steel badge 36 stitch-welded to the back of the restrictor plate 30 (FIG. 2). The badge can be used to provide information, such as from a government or private entity which installed, or cause to be installed, the restrictor plate. For example, the message could be from the U.S.E.P.A. The badge is illustrated as circular, having a diameter essentially the size of drain holes in the restrictor plate (discussed below) and is located near a side edge of the restrictor plate. However, other shapes, sizes and locations would be suitable.

As indicated, the restrictor plate 30 has plural drainage openings 34 (FIG. 2) disposed along the length of the restrictor plate 30, which allow for continued drainage while restricting larger floatables. The size and shape of the openings is governed by local government code to provide proper drainage and filtration. For example, under U.S.E.P.A. regulations, these openings are less than seven square inches, or, have a clear space no bigger than two inches across the smallest dimension, which, as illustrated, is along the length of the restrictor plate 30.

Restrictor plate mounting slots 38 (FIGS. 2 and 4) are spaced along the length of the restrictor plate 30. The openings in the slots 38 extend long the width of the restrictor plate 30, so that the slots 38 are vertically oriented. The number of vertical slots 38 is the same as the number of gussets 12 in the curb inlet 10. Each vertical slot 38 is wide enough to allow an attachment bolt 40 (FIGS. 3 and 4) to pass through and continue to a mounting nut 22 disposed adjacent to a mounting hole 28 in the base of the clamp 14. However, each vertical slot 38 is narrow enough to prevent the head of the attachment bolt 40 from passing therethrough. This enables each vertical slot 38 to form a seat for tightening the head of the attachment bolt 40 against the restrictor plate 30 and thereby connect the restrictor plate 30 to the clamp 14.

The opening span of the vertical slot 38 allows for height adjustment of the restrictor plate 30 against the curb inlet 10. As illustrated, the height of the vertical slots 38 is the same as the height of the drainage openings 34 in the restrictor plate 30.

The spacing between adjacent vertical slots 38, i.e., the horizontal spacing, is approximately the same as the spacing provided in literature from the manufacturer for the design spacing for the gussets 12. It is to be appreciated that the spacing between adjacent vertical slots 38 does not account for the manufacturing variations (tolerances) in the gusset spacing.

4. The Base Area of the Clamp and the Clamp Adjusting Bar

The base of the clamp 14 is defined by a flattened fulcrum surface. The flattened surface provides a plane for maintaining the stability of the restrictor plate 30.

The fulcrum surface includes the mounting hole 28, which is in the form of a slot. The slot 28 extends in a direction which is perpendicular to the width of the clamp 14 so that the slot is horizontally oriented. By allowing the attachment bolt 40 to travel along the horizontal slot 28, the horizontal slot 28 enables each clamp 14 to remain fixed to a single gusset 12 while being aligned with the vertical slot 38 in the restrictor plate 30. Accordingly, the horizontal slot 28 is long enough to allow for such adjustments.

Figure 3:
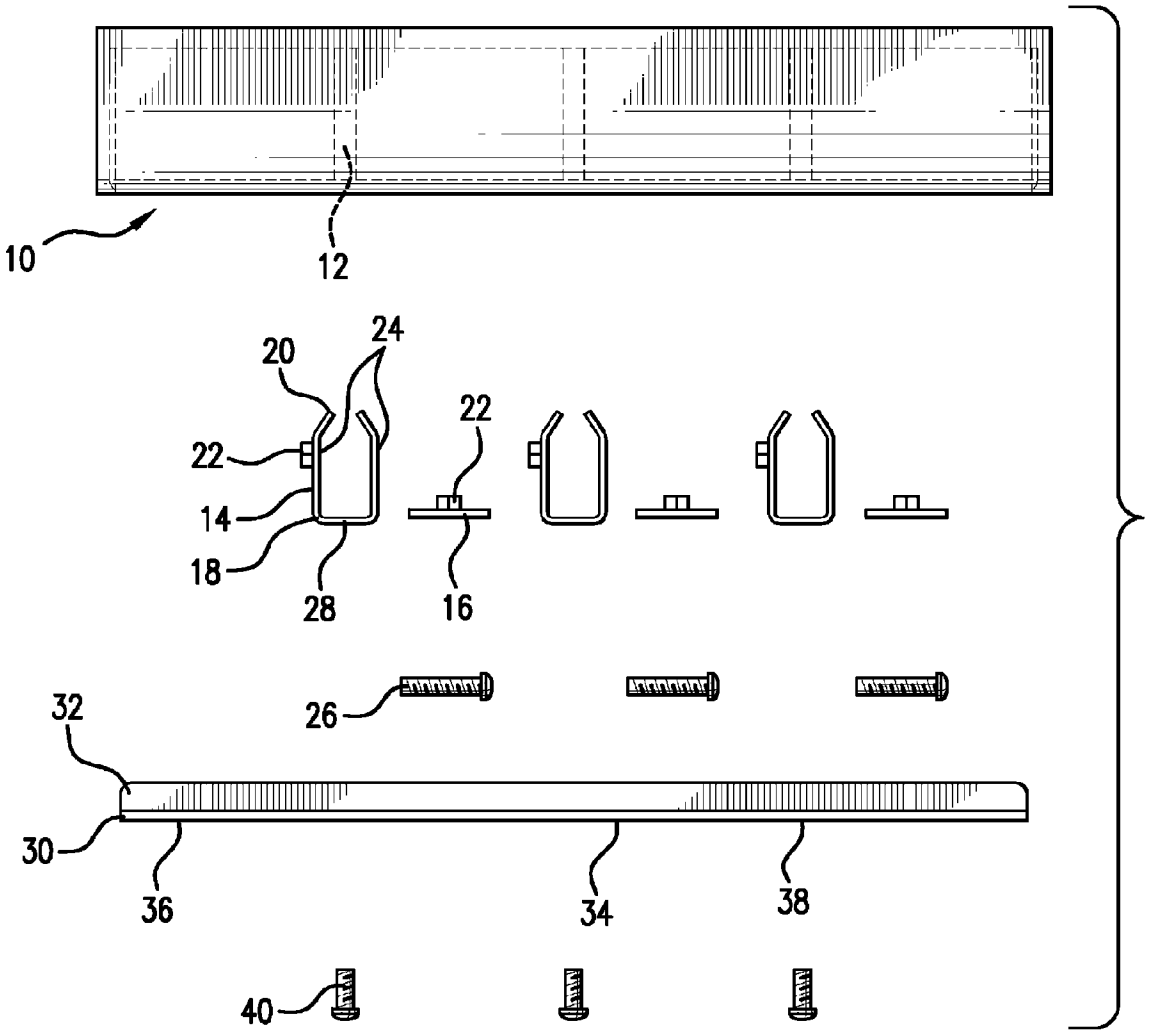
FIG. 3 illustrates a top view of a curb inlet, plural clamps and a restrictor plate.
Figure 4:
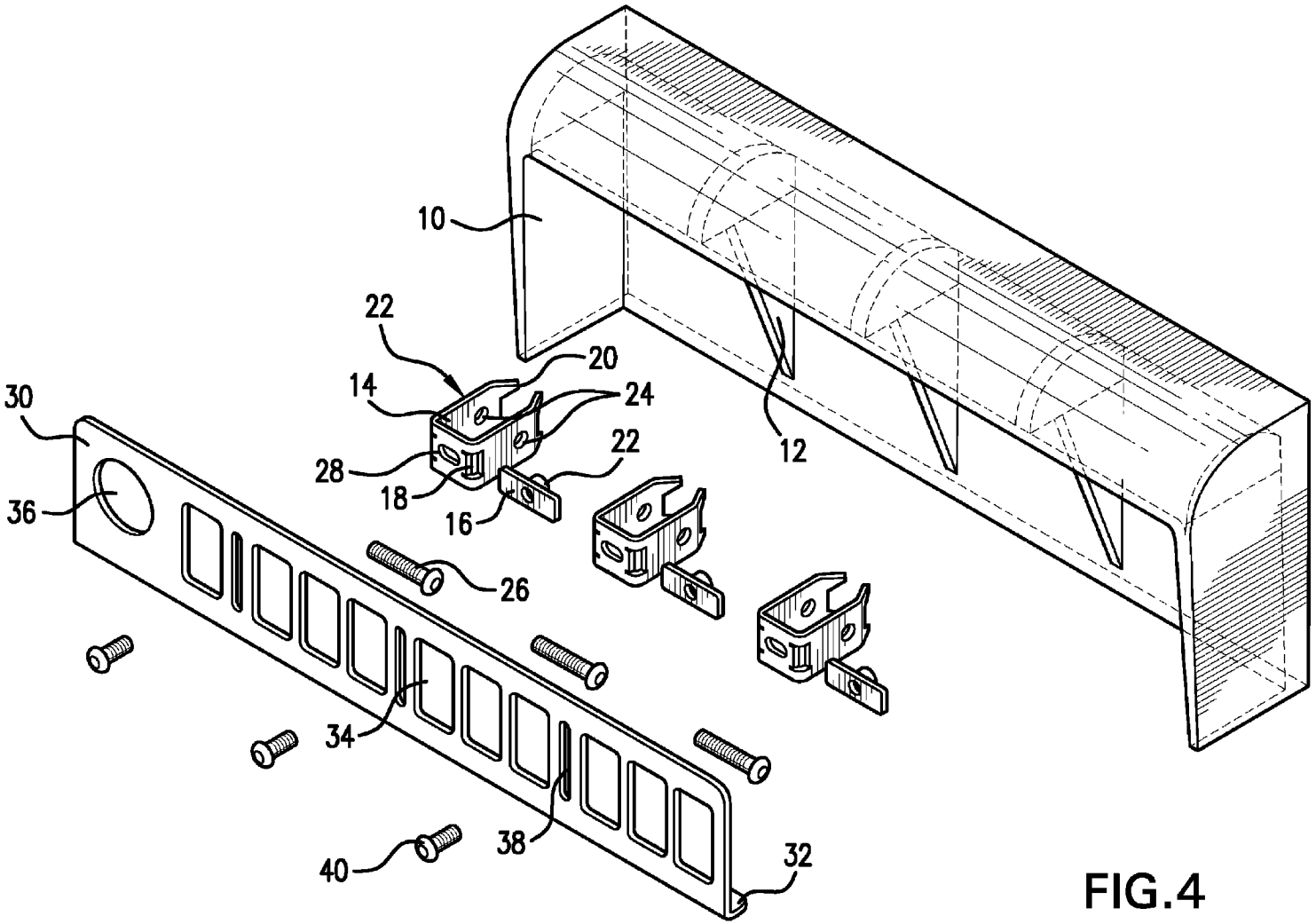
FIG. 4 illustrates a perspective view a curb inlet, plural clamps and a restrictor plate.

A flattened clamp adjusting bar 16 is slidably positioned within the clamp 14, against the fulcrum (FIGS. 1, 3 and 4). The above referenced mounting nut 22, which is coaxial with the horizontal slot 28, is indirectly secured to the clamp 14 and, rather, directly connected to the clamp adjusting bar 16.

The cross section of the clamp adjusting bar 16 is rectangular, having a smaller width than that of the clamp 14. For example, the width of the clamp adjusting bar is roughly half of the width of the clamp 14. The clamp adjusting bar 16 has a cross section which enables the adjusting bar 16 to slide through a pair of co-planar slots 18 in the clamp 14 sidewalls (discussed below).

The clamp adjusting bar 16 is longer than the outside dimension of the clamp 14, in the direction in which the adjusting bar 16 slides, i.e., in the direction perpendicular to the width of the clamp 14. This prevents the clamp adjusting bar 16 from falling out of the clamp 14 during adjustment.

The clamp adjusting bar 16 includes a centrally disposed guide hole, at which location the mounting nut 22 is welded (FIG. 3). Furthermore, the mounting nut 22 is welded to the clamp adjusting bar 16 after the clamp adjusting bar 16 is positioned in the clamp C. The post-insertion welding of the mounting nut 22 serves to lock the adjusting bar 16 into the clamp 14 and prevents loss in shipping or installation.

The sidewalls of the clamp, which extend substantially perpendicularly from the fulcrum of the clamp, are spaced along the axis perpendicular to the width of the clamp 14. Accordingly, the sidewalls are separated by a distance which is at least large enough to allow for full adjustment of the clamp adjusting bar 16 against the clamp 14. It is to be appreciated that such spacing is larger than the thickness of gussets 12 in the curb inlet 10.

According to the above configuration, each attachment bolt 40 passes through a vertical slot 38 in the restrictor plate 30, through the horizontal fulcrum slot 28 in the clamp 14, though the guide hole in the clamp adjusting bar 16 and into the mounting nut 22. This configuration floats the restrictor plate 30 at the curb inlet opening and obviates problems which would otherwise exist due to misalignments between the gussets 12 and the restrictor plate slots 38.

i. The Clamp Sidewalls and Prongs

As illustrated in FIGS. 1, 3 and 4, the length of each sidewall is approximately twice the width of the clamp fulcrum. The length is designed around proper seating of the resister plate against the front face of the curb inlet.

As indicated, above, each side wall has a slot 18. The slots 18 are positioned adjacent to the clamp fulcrum so that the adjusting bar 16 may slide directly against the fulcrum surface. The slots 18 have the same shape as the cross section of the adjusting bar 16 and is larger for enabling the adjusting bar 16 to slide freely therein during adjustment. Clearly, the height of the slot 18, while larger than the thickness of the adjusting bar 16, is not larger than the combination of the adjusting bar 16 and the mounting nut 22.

At the upper end of each sidewall, the clamp 14 includes prongs 20. Each prong 20 includes a free edge, with a curve defining the upper half of a "V". The prongs 20 are bent inwardly so as to close the distance about a gusset 12 to which the prongs 20 will connect. However, the bend angle is small enough to prevent excess shear forces from building up at upper end of the sidewalls. For example, the bend angle is approximately thirty degrees from the long axis of the sidewall. The inwardly angled prongs 20 make the clamping action against some or all of the gussets 12 when the clamp 14 is tightened. It is to be appreciated that opposing prongs 20 are utilized because gussets 12 are uneven due to inconsistencies in the sand molding/casting operation. Such a molding process creates a rough finish and such a process requires utilizing draft angles on patterns. The effect of such a process is the creation of odd slopes and angles on the gussets 12. The individual points of the clamping prongs 20 allow for individual contact upon uneven gussets 12 to maximize the clamping effort.

Furthermore, the length of the prongs 20 is such that the prong ends 20 are separated by a distance which allows the prongs 20 to be freely positioned about the gussets 12 before being clamped against the gussets 12. For example, the distance between the free ends of the opposing prongs 20 is twice the thickness of a gusset 12.

Each sidewall in the clamp 14 has a guide hole 24 (FIG. 1). The guide holes 24 are centered along the sidewall width. The guide holes 24 are axially aligned and are designed to receive a clamping bolt 26. The guide holes 24 are positioned close to the prongs 20 to enable maximum deflection of the prongs when tightening the clamping bolt 1.

A clamping nut 22 (FIGS. 1, 3 and 4) is welded on the outside of one of the guide holes H. Accordingly, the clamping bolt 26 is capable of being passed through one guide hole, across the clamp 14, through the opposing guide hole, and into the clamping nut 22. As can be appreciated, as the clamping bolt 26 is tightened, the clamp 14 deforms under the clamping pressure and the prongs 20 individually clamp into the gusset 12 allowing for maximum clamp pressure on any uneven surfaces.

Figure 5:
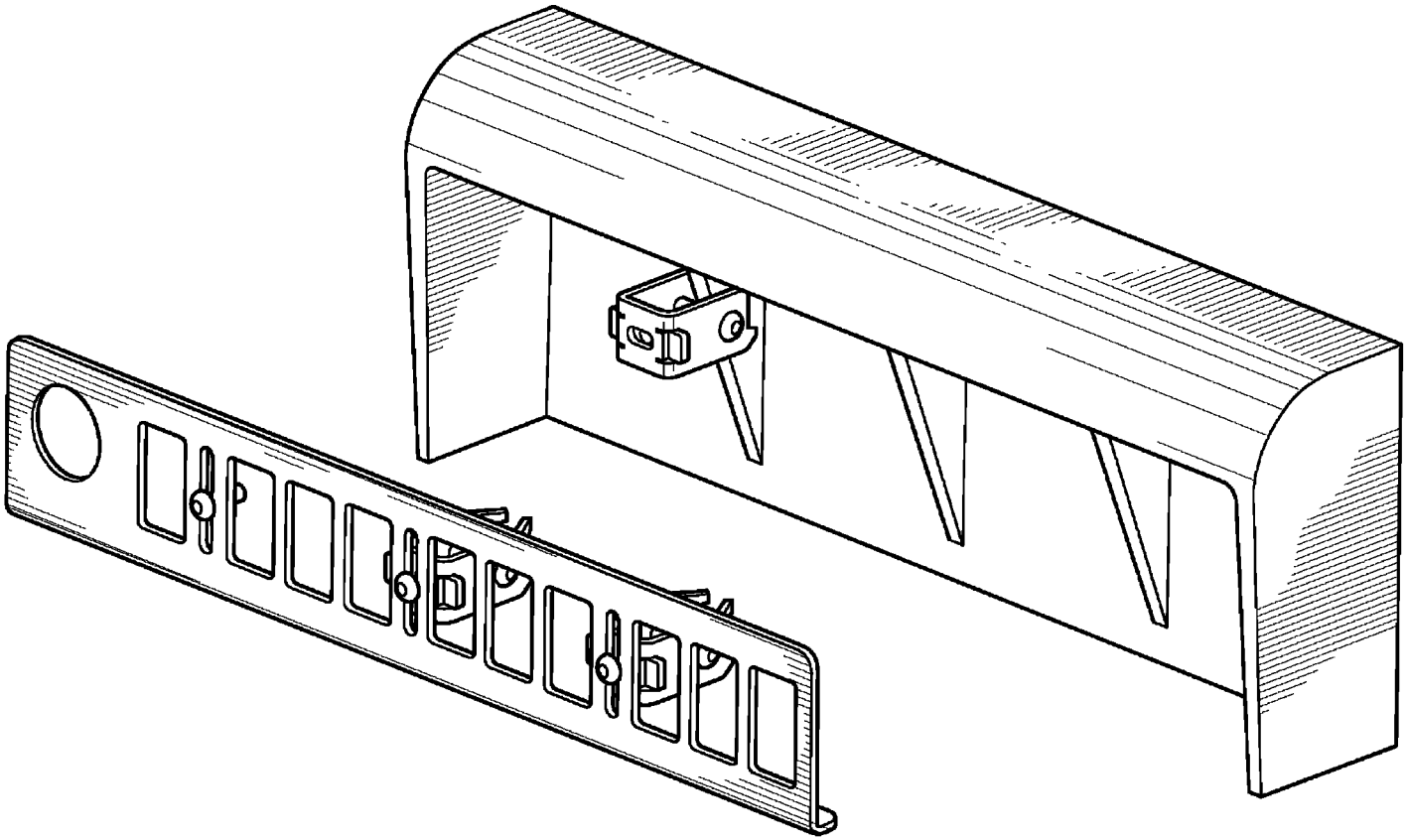
FIG. 5 illustrates connecting a restrictor plate to a curb inlet.
Figure 6:
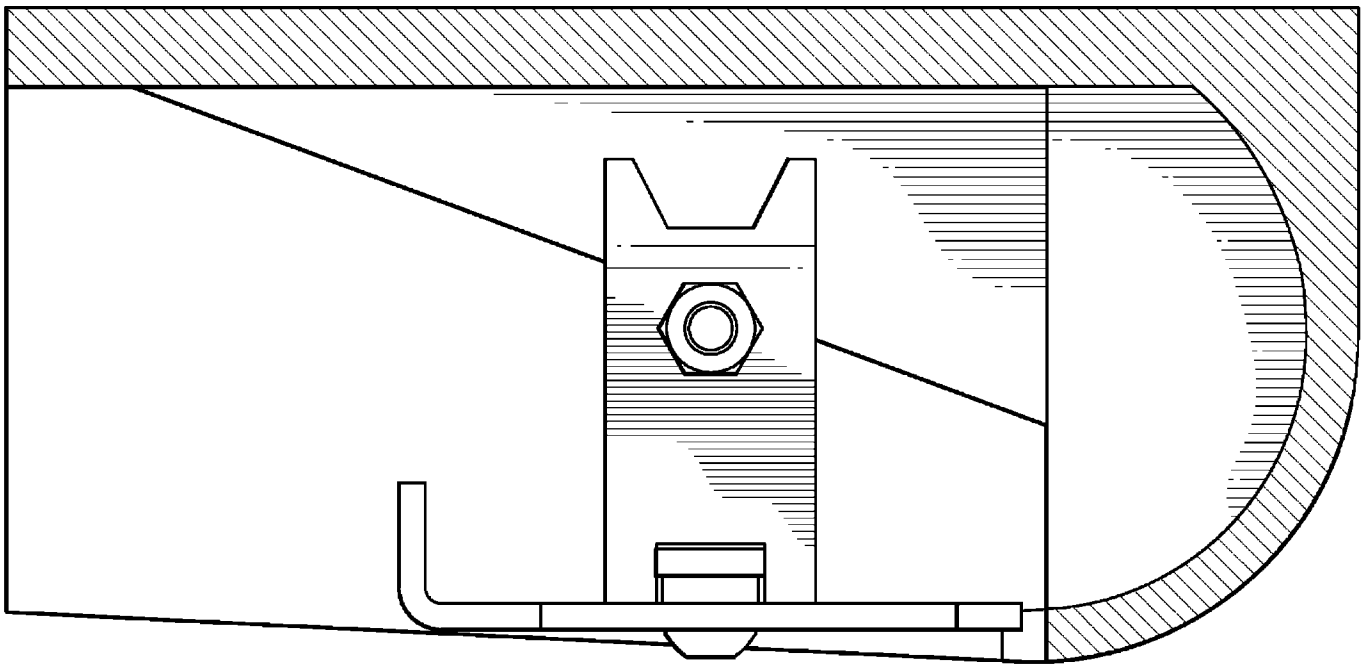
FIG. 6 further illustrates connecting a restrictor plate to a curb inlet.
Figure 7:
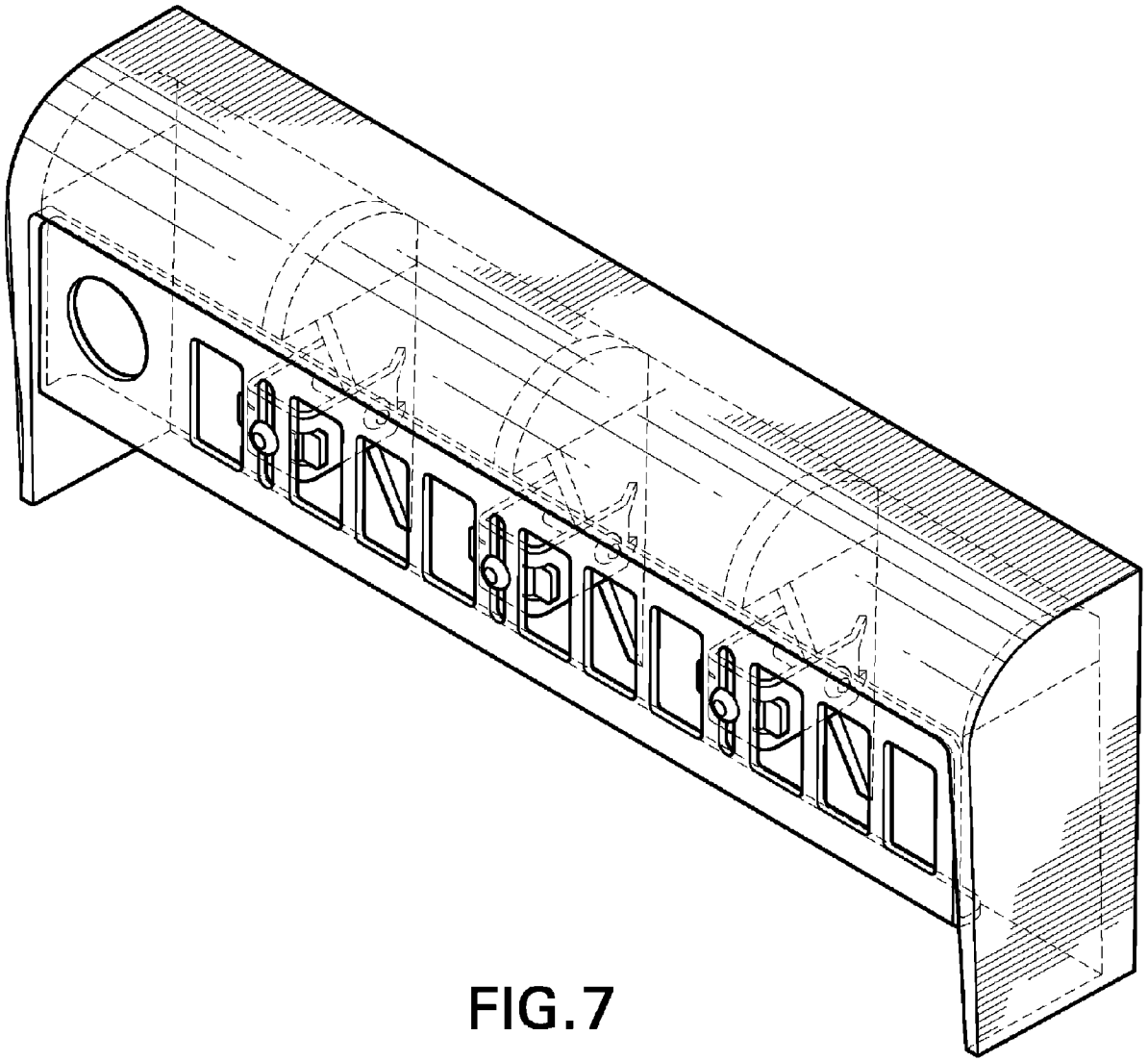
FIG. 7 yet further illustrates connecting a restrictor plate to a curb inlet.

As illustrated in FIGS. 5-7, when a clamp 14 fully engages a gusset 12 in a curb inlet 10, the shank of the clamping bolt 26 rests against the narrow edge of the gusset 12. Each gusset 12 has a triangular profile at the location at which the clamp bolt 26 engages the gusset 12. Accordingly, moving the clamp 14 upwardly and downwardly along the gusset 12, while maintaining a contact between the gusset 12 and the clamp bolt 26, will increase or decrease the distance between the back face of the curb inlet 10 and the fulcrum of the clamp 14. As such, the guide holes 24 provide for both height and depth adjustment of the clamp 14, and therefore the restrictor plate 30, with respect to the curb inlet 10.

It is noted that the depth positioning of the restrictor plate 30 with respect to the curb inlet 10 is dependant on maximum standard installed height of the catch basin. This positioning of the restrictor plate 30 protects the restrictor plate 30 from vehicular or snow plow impact. This positioning also prevents the restrictor plate 30 from impinging on the grate of the catch basin if the curb height needs to be adjusted, or if the grate is raised for paving overlay.

Materials

The inventors contemplated utilizing ¼" thick, A588 grade, Cor-Ten (trademark held by United States Steel Corporation) weathering steel for all materials, including the clamp, the adjusting bar and the restrictor plate. Such material is designed to "weather" (i.e., oxidize over time) to the patina of the cast iron inlet of the curb inlet 10 in which the materials are installed. A588 Cor-Ten weathering steel shares the same rust inhibiting properties as cast iron to provide years of service with no need for painting. Furthermore, the clamp and adjusting bar were contemplated to be 2" wide. Moreover, the type of bolt contemplated by the inventors, for all uses, was a 5/16" hex socket bolt.

However, one of ordinary skill would understand that various material types, thickness and overall dimensions could be applied so long as the clamp 14 is capable of mounting on the gussets 12 of the curb inlet and anchoring the restrictor plate 30 to the curb inlet 10.

In use, the method of installing the restrictor plate 30 to the curb inlet 10 is a two step process. The first step is securely installing the clamps 14 on the gussets 12. The second step is installing the restrictor plate 30 to the clamps A. This two step installation makes the installation easier and allows for future replacement of the restrictor plate 30 without having to replace any clamp 14.

In sum, the following features are provided by the invention:

1) A clamped plate system is provided which restricts the inflow of floatables into storm water systems through catch basin curb inlets.

2) The clamped plate system uses the integral parts of the catch basin curb inlet as anchors for the restrictor plate.

3) The clamped plate system allows curb and/or grate adjustment for paving or curb line reconstruction to not interfere with the restrictor plate installation.

4) The clamped plate system mounts the restrictor plate inside the plane created by the front wall of the curb and its front face opening.

5) This mounting position lessens the potential for damage from vehicle of snow plow impact.

6) The pronged clamp used in the clamped plate system uses the prongs at the clamping end to provide maximum clamping effort on uneven gusset surfaces.

7) The pronged clamp uses the deformation of its steel shape caused by the tightening of the clamping bolt to create the clamping pressure.

8) The restrictor plate has openings designed to allow continued inflow of water while restricting larger floatables per EPA Stormwater Control Act mandates and specifications.

9) The restrictor plate has a full length Bend along the upper and/or lower edge to create intersecting connected planes to add rigidity. This rigidity lessens the potential for incidental impact damage.

10) The restrictor plate has a stitch welded steel badge, viewable through an opening in the Plate. The steel badge carries an educational message per USEPA Stormwater Control Act mandates and specifications.

11) The restrictor plate is attached to the pronged clamp through slots which allow vertical adjustment.

12) The adjusting bar in conjunction with the clamp slot allows for horizontal adjustment between the restrictor plate and the pronged clamp to accommodate varying field conditions.

13) The pronged clamp can be installed on the gussets before the restrictor plate is attached.

14) The restrictor plate can be replaced without removing the pronged clamp.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

I claim:

1. A clamp for securing a restrictor plate so as to be co-planar with a front face of or within a curb inlet of a storm drain catch basin, said clamp comprising:

a flattened base adapted to seat against said restrictor plate;

a pair of sidewalls substantially perpendicular to and extending from opposing ends of said flattened base, each of said sidewalls terminating at a distal end in a gripping portion capable of gripping a section of said curb inlet; and an adjustment member slidably disposed against said flattened base and through co-planar slots in said pair of sidewalls, wherein an aperture in said adjustment member may be slidably positioned for access through a slot in said flattened base for securing said flattened base to said restrictor plate, the slot in said flattened base having a greater length along a first axis than along a second axis, the first axis extending between and substantially perpendicular to said sidewalls and the second axis extending perpendicularly to the first axis, and wherein said aperture in said adjustment member is capable of being slidably positioned across substantially an entire extent of said greater length of said slot in said flattened base.

2. The clamp of claim 1 wherein:

each of said gripping portions includes a pair of prongs that are inwardly bent from an adjoining one of the pair of sidewalls, thereby capable of being secured against gussets in the curb inlet.

3. The clamp of claim 1 further comprising:

a gusset edge engaging member which is configured to movably engage a forward edge of the gusset extending at an acute angle to a rear vertical wall of the curb inlet, such that movement of the clamp along forward edge of the gusset adjusts a depth and height of the restrictor plate relative to an opening of the curb inlet.

4. The clamp of claim 3, wherein said gusset edge engaging member is a clamping bolt, which is secured between the pair of sidewalls in said clamp.

5. A system including the clamp of claim 3 and a restrictor plate.

6. The system of claim 5 wherein the restrictor plate includes slots for engaging a fastener, said fastener fastening said restrictor plate to said flattened base of said clamp.

7. The system of claim 6 wherein the restrictor plate has openings for allowing inflow of water while restricting floatables above a predetermined size.

8. The system of claim 7 wherein the restrictor plate has a lengthwise bend along the upper and/or lower edge of the restrictor plate, said bend increasing the rigidity of said plate.

9. The system of claim 8 wherein said bend is substantially perpendicular to said restrictor plate.

10. The system of claim 9 wherein said plate includes a view hole therein.

11. The system of claim 3 wherein the restrictor plate is attached to the clamp through vertical slots in the restrictor plate, said slots allowing for vertical adjustment of said restrictor plate relative to said clamp.

12. The system of claim 5 wherein said slidably-disposed adjustment member of said clamp enables a horizontal adjustment between the restrictor plate and the clamp, so that the clamp is capable of being secured to the restrictor plate when the clamp and restrictor plate are misaligned.

13. The system of claim 5 wherein said clamp further comprises a bolt threadably connected to said aperture in said adjustment member, whereby said adjustment member may be slidably connected to said restrictor plate.

14. A method of installing, into a catch basin curb inlet which has a plurality of gussets, the system of claim 3, including a plurality of the clamps and the restrictor plate, said method comprising:

installing each of said plural clamps against a corresponding one of said plurality of gussets in said curb inlet; and subsequently attaching selected portions of the restrictor plate to said plurality of clamps;

wherein said selected portions of said restrictor plate a capable of being aligned with the clamps even when said gussets are out of alignment with said selected portions of said restrictor plate.

* * * * *